US007548716B2

(12) United States Patent
Radulski

(10) Patent No.: US 7,548,716 B2
(45) Date of Patent: Jun. 16, 2009

(54) COLOR GAMUT AND ENHANCED TRANSFER USING HYBRID ARCHITECTURE DESIGN

(75) Inventor: Charles A. Radulski, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 227 days.

(21) Appl. No.: 11/780,086

(22) Filed: Jul. 19, 2007

(65) Prior Publication Data

US 2009/0022526 A1 Jan. 22, 2009

(51) Int. Cl.
*G03G 15/01* (2006.01)

(52) U.S. Cl. ..... 399/298; 399/302; 399/308

(58) Field of Classification Search ..... 399/107, 399/119, 298, 299, 301, 302, 308
See application file for complete search history.

(56) References Cited

U.S. PATENT DOCUMENTS

| | | | | |
|---|---|---|---|---|
| 4,684,238 | A | 8/1987 | Till et al. | |
| 4,690,539 | A | 9/1987 | Radulski et al. | |
| 4,736,227 | A | 4/1988 | Till et al. | |
| 5,016,055 | A | 5/1991 | Pietrowski et al. | |
| 5,512,990 | A | 4/1996 | Friel et al. | |
| 5,517,291 | A | 5/1996 | Montfort et al. | |
| 5,557,393 | A * | 9/1996 | Goodman et al. | 399/223 |
| 6,047,155 | A | 4/2000 | Pietrowski et al. | |
| 6,606,477 | B2 | 8/2003 | Thompson et al. | |
| 6,611,665 | B2 | 8/2003 | DiRubio et al. | |
| 6,915,095 | B2 | 7/2005 | Longhenry et al. | |
| 6,975,819 | B2 * | 12/2005 | Katamoto | 399/82 |
| 7,116,933 | B2 * | 10/2006 | Okada | 399/285 |
| 7,177,572 | B2 | 2/2007 | DiRubio et al. | |
| 2006/0066885 | A1 | 3/2006 | Anderson et al. | |
| 2006/0114497 | A1 | 6/2006 | Anderson et al. | |
| 2006/0291885 | A1 | 12/2006 | Radulski et al. | |
| 2007/0081828 | A1 | 4/2007 | Radulski et al. | |

OTHER PUBLICATIONS

Lux, Rick et al. "Is Image-on-Image Color Printing a privileged printing architecture for Production Digital Printing Applicatinos?" *IS&T's NIP 20: International Conference on Digital Printing Technologies*. Oct. 31, 2004.

* cited by examiner

*Primary Examiner*—Hoan H Tran
(74) *Attorney, Agent, or Firm*—Oliff & Berridge, PLC

(57) ABSTRACT

A color printing machine with a hybrid development architecture is provided including a photoreceptor, a first and second set of development housings, a biased transfer belt, and a fuser. The first set of development housings are arranged in an image-on-image configuration in proximity to the photoreceptor. The biased transfer belt is in proximity to the photoreceptor at a transfer station. The second set of development housings are arranged in a tandem configuration in proximity to the biased transfer belt. The fuser is in proximity to the biased transfer belt.

20 Claims, 3 Drawing Sheets

COLOR GAMUT AND ENHANCED TRANSFER USING HYBRID ARCHITECTURE DESIGN

BACKGROUND

This disclosure generally relates to digital color printing machines, such as printers, copiers and scanners and specifically relates to improving color printing and enhancing paper handling.

Color images are typically produced by the well-known process of electrophotographic or xerographic printing. In electrophotographic printing, a charge retentive surface, typically known as a photoreceptor, is charged, and then exposed to a light pattern to selectively discharge the surface according to a desired image. The resulting pattern of charged and discharged areas on the photoreceptor forms an electrostatic charge pattern, known as a latent image. The latent image is developed by contacting it with a finely divided electrostatically attractable powder known as toner. Toner is held on the image areas by the electrostatic charge on the photoreceptor surface. After the toner image is produced in conformity with the light image of the desired image, the toner image may then be transferred to a substrate and then affixed (fused) to form a permanent image on the substrate. The charge retentive surface is then cleaned to prepare for subsequent development.

In the process of electrophotographic printing, the step of conveying toner to the latent image on the photoreceptor is known as development. In the development process, there are two commonly used development materials: single-component developer and two-component developer. Single-component developer consists entirely of toner, while two-component developer consists of toner particles and carrier beads. One type of toner is emulsion aggregation (EA) toner, which is characterized by it's spherical shape.

In two-component developer material, the toner particles are triboelectrically adhered to the carrier beads. When the developer material is placed in a magnetic field, the toner particles adhered to the carrier beads form what is known as a magnetic brush. The carrier beads form chains that resemble the fibers of a brush. This magnetic brush is typically created by a developer roll. One type of development that uses a magnetic brush is semi-conductive magnetic brush development (SCMB). Examples of other development systems include hybrid scavengeless development, hybrid jumping development and standard magnetic development. The developer roll is typically a cylindrical sleeve rotating around a fixed assembly of magnets. The carrier beads form chains extending from the surface of the developer roll. The toner particles are electrostatically attracted to the chains of the carrier beads. When the magnetic brash is introduced into a development zone adjacent to the electrostatic latent image on a photoreceptor, the electrostatic charge on the photoreceptor causes the toner particles to be pulled off the carrier beads and onto the photoreceptor.

In single-component developer material, each toner particle has both an electrostatic charge to enable the particles to adhere to the photoreceptor and magnetic properties to allow the particles to be magnetically conveyed to the photoreceptor. Instead of using magnetic carrier beads to form a magnetic brush, the magnetized toner particles adhere directly to a developer roll. In the development zone adjacent to the electrostatic latent image on the photoreceptor, the electrostatic charge on the photoreceptor causes the toner particles to be attracted from the developer roll to the photoreceptor.

A variation on the development process is scavengeless development. In a scavengeless development system, toner is detached from the donor roll by applying an AC electric field to self-spaced electrode structures, commonly in the form of wires positioned in the nip between a donor roll and a photoreceptor. This forms a toner powder cloud in the nip and the latent image attracts toner from the powder cloud. Because there is no physical contact between the development apparatus and the photoreceptor, scavengeless development is useful for devices in which different types of toner are supplied onto the same photoreceptor, such as in tri-level, recharge, expose and develop, highlight, or image-on-image digital color printing.

Since 1995, there have been many advances in high speed digital color printing technologies. The advances in marking technologies, from ink jet to xerography, with dry and liquid toners, have resulted in a diversity of products, each having speed and print qualities suitable for specific markets, such as small office or home office, general office, production printing, proofing and photo-finishing machines. At the same time, advances in microprocessors have enabled image processing and process control in digital color printing machines. These advances have increased productivity, image quality, substrate latitude, and run cost.

Digital color printing technology is still evolving to improve productivity, image quality, substrate latitude, and run cost. Each emerging technology has its own niches and barriers. For example, ink jet printing is architecturally simple, but presents challenges in the design of a quick drying, moisture resistant ink and robust page-wide ink heads for high speed printing on a wide selection of substrates at a reasonable run cost.

Three types of tandem architectures for electrophotographic or xerographic printing have emerged that vary primarily in where the color image is built (i.e., constructed or accumulated). The color image separations may be built on (1) paper, (2) an intermediate belt or drum or (3) a photoreceptor. The term tandem is used herein to refer to architectures where the color image separations are built either on paper or on an intermediate belt or drum in contrast to tandem architectures, the term image-on-image (IOI) is used herein to refer to architectures where the color image separations are built on a photoreceptor, and then transferred directly to a substrate (e.g., paper) or to an intermediate belt or drum. One fundamental difference between the tandem architecture and the image-on-image architecture is where the color image is built.

The color images produced by image-on-image or tandem digital color printing machines are typically four color images. In the image-on-image architecture, the four color image is built on one photoreceptor and transferred in a single step to a substrate (e.g., a plain piece of paper). Building the color image on the photoreceptor includes placing different colors on top of as well as adjacent to each other. In the tandem architecture, the four color image is built either on paper or on an intermediate belt or dram. Each color is transferred separately from one photoreceptor to the substrate, either directly to the substrate or through the intermediate belt or drum. Thus, another difference is throughput. Image-on-image architectures may apply multiple colors in a single transfer cycle, whereas tandem architectures require multiple cycles with one color being laid down during each cycle.

Digital color printing technology is still evolving and the performance of conventional digital color printing is currently limited by two problems. First, the color gamut is limited. Second, transfer subsystems sometimes cause lead and trail edge defects and wrinkle defects, especially for lightweight coated stock.

A color gamut is a range of producible colors. Different color reproduction techniques have different color capabilities or gamuts. For example, color transparency films have comparatively large gamuts, as do color monitors. The color gamut that can be produced using process inks of cyan, magenta, yellow and black (K)(CMYK) toners on paper is similar. This is why some colors that can be displayed on a color monitor, especially bright saturated colors, cannot be produced exactly by a digital color printing system or a printing press. When printed, colors that fall outside of the printer gamut are typically mapped to printable colors.

Transfer subsystems in a digital color printing system move sheets of media along a path inside the machine. The path a print job follows from creation to destination is called workflow. For example, a transfer subsystem may move sheets from input feeders or trays through various stations of the imaging process, including development, and then to output stacks.

Digital production presses have many applications, including short-run on demand printing of brochures, books, flyers, postcards, newsletters, catalogs, manuals, point of purchase materials and sell sheets. Various kinds of stock may be used in such applications, including coated, uncoated, textured, smooth and specialty stock. Of these, lightweight coated stock may be used to print textbooks on production equipment for digital color printing, such as a digital production press. Stock is sheets of media, such as paper.

Exemplary embodiments include a xerographic printing machine including a photoreceptor, a first and second set of different development housings, a biased transfer belt, and a fuser. The first set of development housings are arranged in an image-on-image configuration in proximity to the photoreceptor. The biased transfer belt is in proximity to the photoreceptor at a transfer station. The second set of development housings are arranged in a tandem configuration in proximity to the biased transfer belt. The fuser is in proximity to the biased transfer belt.

In exemplary embodiments, the first and second development housings may include color toners. One or more of the first or second set of development housings may perform semi-conductive magnetic brush development. In a particular embodiment, there are four development housing in the first set, each housing including one of four different color toners, while the second set of development housings includes at least two additional color toners.

The xerographic printing machine may also include biased transfer rollers made from, for example, at least one of the following materials: metal, rubber, polyamid, elastomer, or foam. The biased transfer rollers may be sized to allow a substrate to self-strip from the surface of the biased transfer belt. In exemplary embodiments, the biased transfer belt may be entrained around the biased transfer rollers and adapted to rotate. Additionally, the biased transfer belt may have a plurality of layers and/or a back coating.

EMBODIMENTS

Figure 1:
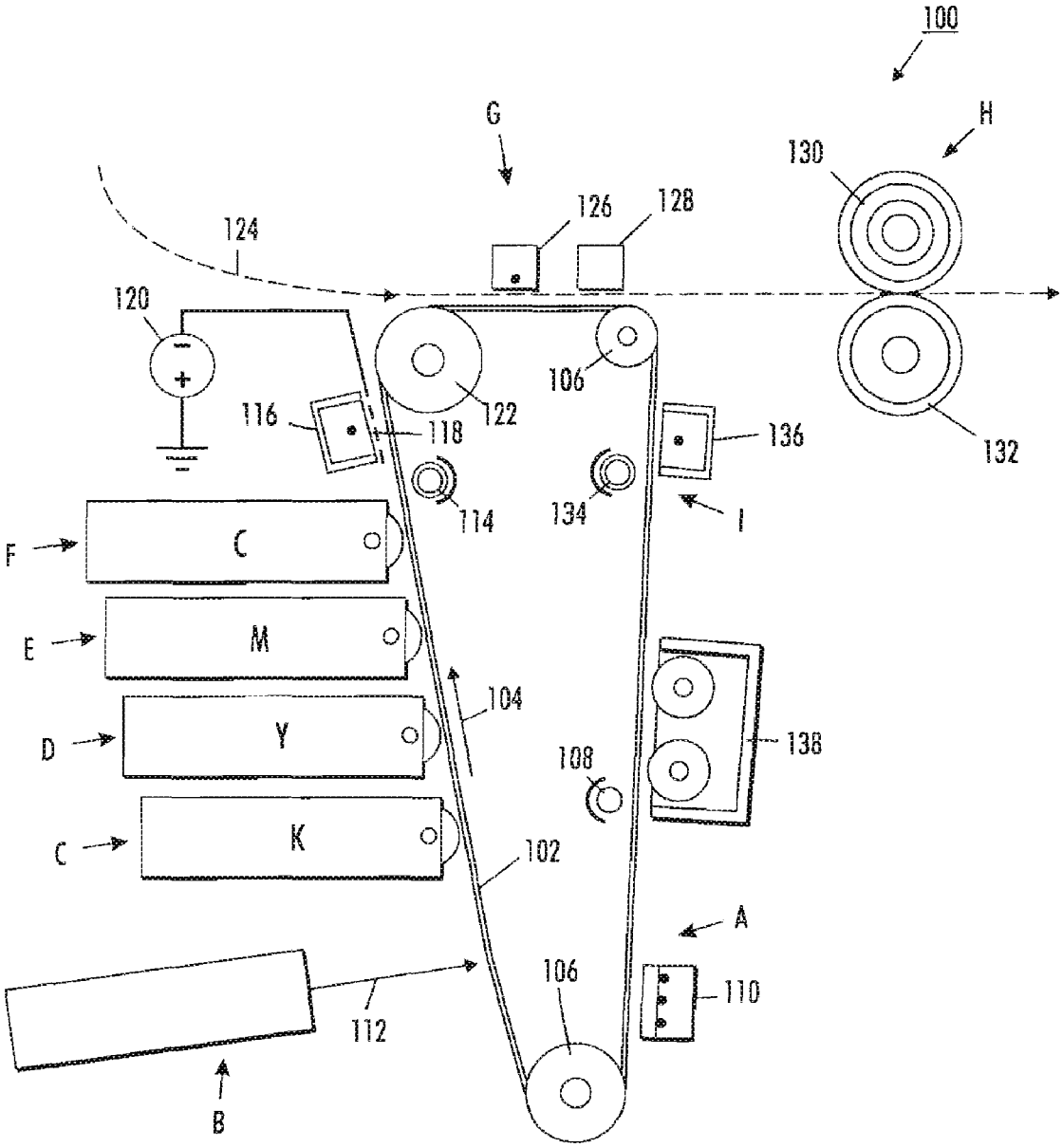
FIG. 1 RELATED ART
FIG. 1 illustrates a portion of a four cycle electrophotographic printing machine including image-on-image technology in the related art.

FIG. 1 illustrates a portion of a four cycle electrophotographic printing machine 100 including image-on-image technology as described in U.S. Pat. No. 6,047,155, which is hereby incorporated by reference in its entirety. The printing machine 100 includes an active matrix (AMAT) photoreceptor belt 102, which travels in the direction indicated by arrow 104. Belt travel is brought about by mounting the photoreceptor belt 102 about a driver roller that is driven by a motor (not shown) and tension rollers 106.

The printing machine 100 produces a color image in four cycles; one cycle for each of the four colors cyan, magenta, yellow, and black (CMYK). A cycle occurs when an image area of the photoreceptor belt 102 travels once around through a series of processing stations. The image area is a portion of the surface of the photoreceptor belt 102 upon which various toner layers are built. The toner layers are transferred and fused to a substrate to produce the final color image. While the photoreceptor belt may have numerous image areas, each image area is typically processed in the same way. In one cycle, the photoreceptor belt 102 may travel through a selection of the following processing stations: charging station A, exposure station B, black development station C, yellow development station D, magenta development station E, cyan development station F, transfer station G, fuser station H and cleaning station I.

The first cycle begins with charging station A. Charging station A includes a pre-charge erase lamp 108 and an AC scorotron 110. The pre-charge erase lamp 108 illuminates the image area so as to cause any residual charge that might exist on the image area to be discharged (erased). The AC scorotron 110 charges the image area to a substantially uniform potential (e.g., −500 volts) in preparation for exposure to create a latent image for black toner. The charge placed on the photoreceptor for the black toner and other toner layers depends upon many variables, such as toner mass and the settings of subsequent development stations.

At exposure station B, the charged image area is exposed to a modulated laser beam 112 that raster scans the image area to produce an electrostatic latent representation of the black image. For example, illuminated sections of the image area might be discharged by the laser beam 112 to, for example, about −50 volts. After exposure, the image area may have a voltage profile comprised of relatively high voltage areas of, for example, about −500 volts and of relatively low voltage areas of, for example, about −50 volts.

The black development station C deposits negatively charged black toner particles onto the exposed image area. The charged black toner particles adhere to the illuminated areas of the exposed image area causing the voltage of the illuminated parts of the image area to be, for example, about −200 volts and the non-illuminated parts of the image area remain at, for example, approximately −500 volts. After passing the black development station C, the image area passes through a number of stations (described below) and then returns to charging station A for the second of four cycles.

The second cycle begins at charging station A. The pre-charge erase lamp 108 illuminates the image area to expose the image area and reduce the charges on the image area prior to recharging. The scorotron 110 recharges the image area for exposure and development of the yellow portions of the image. The recharged image area with its black toner layer then advances to the exposure station B.

Exposure station B exposes the image area with the laser beam 112 to produce an electrostatic latent representation of a yellow image. As an example of the charges on the image area, non-illuminated parts of the image area might have a potential of about −450 volts while the illuminated areas are discharged to about −50 volts.

At yellow development station D, yellow toner is deposited onto the exposed image area. Because the image area already has a black toner layer, the yellow development station uses a scavengeless developer. After passing the yellow development station D, the image area passes through a number of stations (described below) and then returns to charging station A for the third of four cycles.

The third cycle begins at charging station A. The image area and its two toner layers are illuminated to discharge the image area. The AC scorotron 110 recharges the image area and its two toner layers in preparation for the exposure station in the third cycle.

The exposure station B again exposes the image area to the laser beam 112, this time with a light representation that discharges some parts of the image area to create an electrostatic latent representation of a magenta image. The image area the advances to a magenta development station E.

Magenta development station E deposits a third toner layer on the image area. This third magenta layer may be developed on a bare photoreceptor or on the previously developed image to create a red color, for instance. The image area with its three toner layers then advances to begin the fourth cycle.

The fourth cycle begins at charging station A. The pre-charge erase lamp 108 again illuminates the image area to expose the image area and reduce the charges on the image area prior to recharging. The scorotron 110 again recharges the image area, which now has three toner layers, to produce the desired charge on the photoreceptor. The substantially uniformly charged image area with its three toner layers then advances once again to exposure station B.

Exposure station B exposes the image area again, this time with a light representation that discharges some parts of the image area to create an electrostatic latent representation of a cyan image. The image area advances to the cyan development station F.

Cyan development station F develops cyan toner onto the image area as either a single layer or on previously developed layers to create other colors. At this point, the image area has four toner layers that together make up a composite color toner image. This composite color toner image may have regions void of toner and regions of one, two, three or four colors. This composite color toner image is comprised of individual toner particles that have widely varying charge distributions. Transferring such a composite toner image onto a substrate would result in a degraded final image. Therefore, the composite toner image is prepared for transfer.

Preparation for transfer is partially performed by illuminating the image area using a pre-transfer erase lamp 114 to discharge most of the residual charges on the image area. The undeveloped portions of the image area are discharged to a substantially uniform level; however, the toner layers have charges that vary widely and may include both positive and negative charges. To further prepare the toner layers for transfer, it may be beneficial to both drive the toner layer surface potentials toward that of the undeveloped portions of the image area and to add charge of an appropriate polarity and magnitude to various portions of the image having different numbers of color toner layers. Black, yellow, cyan and magenta portions of the image, for example, contain a single color layer; red, blue and green colors contain two color layers; and process black contains three color layers. The image area is run past the AC scorotron 116, which has a grid 18 connected to a desired surface potential 120. The AC scorotron 116 supplies positive and negative ions so as to add or neutralize the toner layer surface charges such that the potential across the various toner layers is substantially that of the undeveloped portions of the image area and equal to each other. This operation optimizes the charge distribution in all portions of the composite toner image so as to enhance transfer.

At transfer station G, the image area advances past a drive roller 122. A substrate 124 (e.g., plain piece of paper) is brought into contact with the image area using a sheet feeder (not shown). As the image area on the photoreceptor 102 and the substrate continue to travel, they pass a transfer corotron 126. The transfer corotron 126 applies positive ions onto the back of the substrate 124 to attract the negatively charged toner particles onto the substrate. Because the image layers have a substantially uniform surface potential, the corotron 126 produces a substantially uniform transfer field. The substrate continues its travel past a detack corotron 128 that neutralizes some of the charge on the substrate 124 to assist in separation of the substrate from the photoreceptor 102. As the leading edge of the substrate 124 moves around the tension roller 106, the leading edge of the substrate 124 separates from the photoreceptor 102. The substrate 124 then advances to fuser station H.

At fuser station H, a heated fuser roller 130 and a pressure roller 132 create a nip through which the substrate 124 passes. The combination of pressure and heat at the nip causes the composite color toner image to fuse into the substrate 124. After fusing, a chute (not shown) may guide the support sheets to a catch tray (also not shown) for removal by, for example, an operator.

At cleaning station I, the fused image area on the photoreceptor belt 102 passes a pre-clean erase lamp 134. The pre-clean erase lamp 134 neutralizes most of the charge remaining on the photoreceptor belt 102. After passing the pre-clean erase lamp 134, the residual toner and/or debris on the photoreceptor is treated with an AC corotron 136 for removal. Two electrically biased cleaning rolls 138 remove the residual toner particles and debris from the image area. This marks the end of the fourth cycle. The image area passes once again to charging station A and the start of another four cycles.

Figure 2:
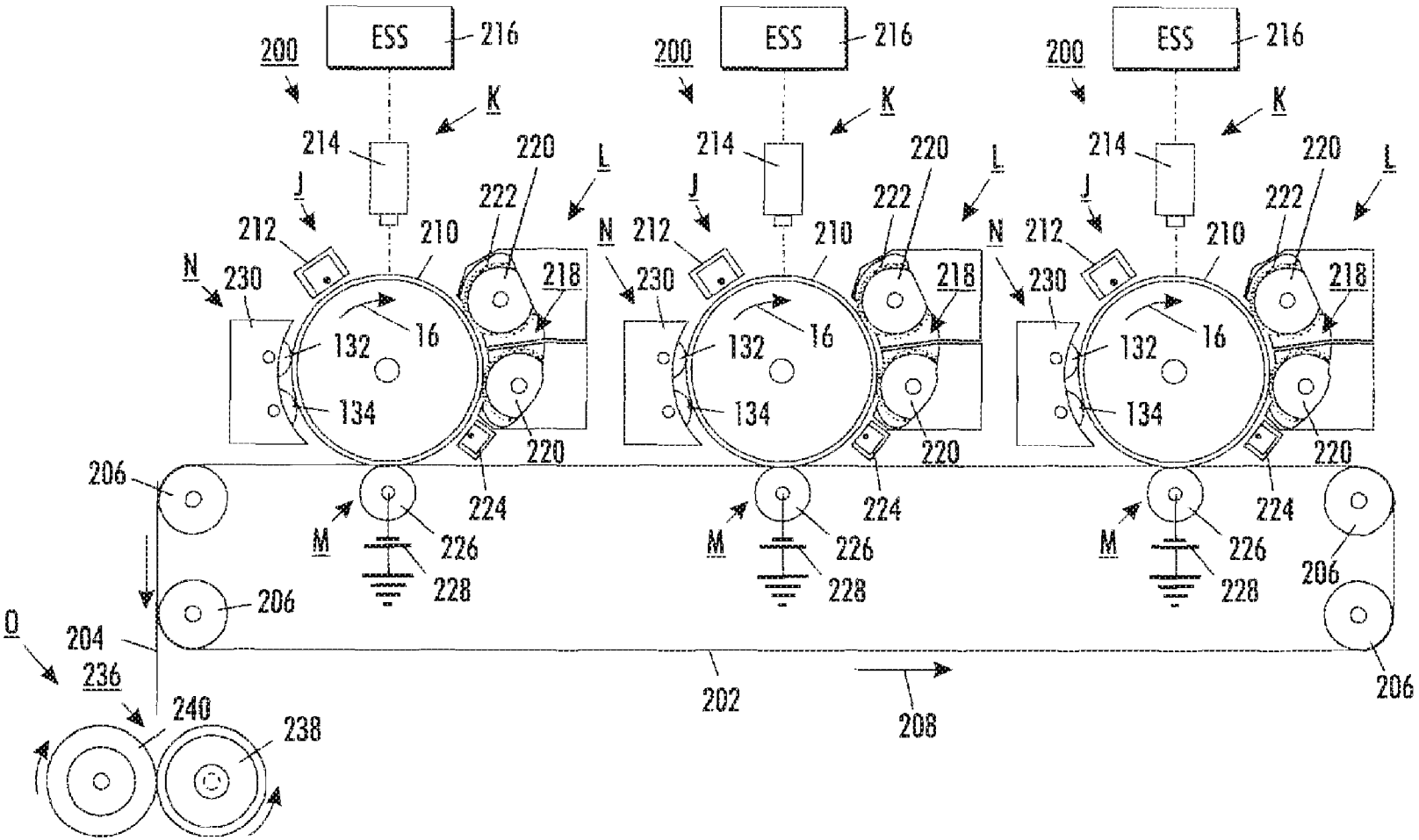
FIG. 2 RELATED ART
FIG. 2 illustrates a portion of a color printing machine including tandem technology in the related art.

FIG. 2 illustrates a portion of a color printing machine including tandem technology in the related art, as described in U.S. Pat. No. 5,337,136, which is hereby incorporated by reference in its entirety. In this exemplary printing machine, three print engines 200 are arranged in a tandem configuration for creating toner images on an intermediate belt 202. The toner images on the intermediate belt 202 are then transferred from the intermediate belt 202 to a substrate 204 (e.g., a piece of plain paper). The intermediate belt 202 may be entrained about a number of rollers 206 and adapted to move in a counter-clockwise direction indicated by arrow 208.

Although there are three print engines 200 in this exemplary embodiment, tandem architecture typically includes four print engines and each print engine 200 typically develops a different one of the four colors. In this exemplary embodiment, each print engine 200 is provided with a development station L capable of developing one primary color plus one other color. For example, each primary color, black, and a highlight or logo color toner may be developed.

Each print engine 200 includes a photoreceptor 210 (e.g., a drum), which is supported for clockwise rotation such that the surface of the photoreceptor 210 moves past the following processing stations: charging station J, exposure station K, development station L, transfer station M and cleaning station N. After the image is transferred from the photoreceptor 210 to the intermediate belt 202 at transfer station M, the intermediate belt moves past fusing station O.

At charging station J, a corona discharge device 212 charges the surface of the photoreceptor 210 to a selectively high uniform potential, the polarity of the charge being dependent upon the material used for the photoreceptor 210. The photoreceptor 210 advances to exposure station K.

At exposure station K, the uniformly charged surface of the photoreceptor 210 is exposed to a laser-based input or output scanning device 214 (e.g., raster output scanner) that causes the surface of the photoreceptor 210 to be discharged in accordance with the output from the scanning device. The inputs and outputs to and from the output scanning device are controlled by an electronic subsystem (ESS) 216. The ESS 216 also controls the synchronization of the photoreceptor 210 with the engines 200 so that toner images being transferred are accurately registered with respect to previously transferred images.

At development station L, a magnetic brush development system 218 advances developer materials into contact with the electrostatic latent images on the photoreceptor 210. The development system 218 includes two magnetic brush developer roll structures 220. Each magnetic brush developer roll structure 220 may include at least a pair of magnetic brush developer rollers, only one of which is shown for clarity. Each pair of rollers advances its respective developer material into contact with the latent image on the photoreceptor 210. Appropriate developer biasing is accomplished via power supplies (not shown) electrically connected to respective magnetic brush developer roll structures 220.

As the photoreceptor 210 makes a single pass by the magnetic brush developer roll structures 220, color discrimination in the development of the electrostatic latent image is achieved. The rollers of the magnetic brush developer roll structures 220 are electrically biased to voltages that are offset from the background voltage. The direction of the offset depends on the polarity of the magnetic brush developer material 222 in the housing of the development system 218.

One magnetic brush developer roll structure 220, for the sake of illustration, may use yellow conductive magnetic brush developer material 222 having triboelectric properties (i.e., negative charge) such that the yellow toner is driven to the least highly charged areas at the potential of the latent image by the electrostatic development field between the photoreceptor 210 and the magnetic brush developer roll structures 220. These rolls 220 are biased using a chopped DC bias via the power supply (not shown).

Another magnetic brush developer roll structure 220, for the sake of illustration, may use black magnetic brush developer material 222 such that the black toner is urged towards the parts of the latent image at the most highly charged potential by the electrostatic development field between the photoreceptor 210 and the magnetic brush developer roll structures 220. These rolls 220 are also biased using a chopped DC bias via the power supply (not shown).

Chopped DC bias means that the housing bias applied to the developer housing is alternated between two potentials, one that represents roughly the normal bias for the developer and the other that represents a bias that is considerably more negative than the normal bias. This alternation of the bias takes place in a periodic fashion at a given frequency, with the period of each cycle divided up between the two bias levels at a duty cycle of from about 5-10% and about 90-95%. Developer bias switching is effected automatically via the power supply (not shown).

At transfer station M, a negative pre-transfer dicorotron member 224 conditions the toner for effective transfer to a substrate using positive corona discharge, because the composite image developed on the photoreceptor 210 consists of both positive and negative toner. An electrically biased roll 226 contacts the backside of the intermediate belt 202 and serves to effect combined electrostatic and pressure transfer of toner images from the photoreceptor 210 of print engine 200 to the intermediate belt 202. A DC power supply 228 of suitable magnitude is provided for biasing the roll 226 to a polarity (in this case negative) so as to electrostatically attract the toner particles from the photoreceptor 210 to the intermediate belt 202.

At cleaning station N, after the toner images are transferred from the photoreceptor 210 to the intermediate belt 202, the residual toner particles carried by the non-image areas on the surface of the photoreceptor 210 are removed. These particles are removed by a cleaning housing 230 supporting therein two cleaning brushes 232 for counter-rotation with respect o the other, each cleaning brush 232 being supported in cleaning relationship with the photoreceptor 210. Each cleaning brush 232 is generally cylindrical in shape, with a long axis arranged generally parallel to the photoreceptor 210 and transverse to the direction of movement (indicated by arrow 234) of the photoreceptor 210. Each cleaning brush 232 has a large number of insulating fibers mounted on a base and each base is respectively journaled for rotation (driving elements not shown). A typical brush rotation speed is 1300 rpm and the interface between the brush 232 and the photoreceptor 210 usually about 2 mm. Brushes 232 beat against flicker bars (not shown) for the release of toner carried by the brushes and for effecting suitable triboelectric charging of the brush fibers.

The print engines 200 are substantially similar, except that the development systems 218 may use toners of different colors. By way of example, a developer system 218 may use magenta toner and either a highlight color or a logo color toner, such as red, blue or green. A development system 218 may contain the third of the primary subtractive colors, i.e., cyan toner, together with either a highlight or logo color toner that is a different color from all of the rest of the toners.

At fusing, station O, the transferred image on the substrate is permanently affixed to the substrate. A fuser device 236 includes a heated roll member 238 and a pressure roll member 240 that cooperate to fix the composite toner image to the substrate.

In the example of FIG. 2, the composite toner image is effected in a spot next to spot manner, which is characteristic of a tri-level imaging process. However, when images are transferred to the intermediate belt 2021 subsequent to the first image transfer, the transfer may be effected in a spot next to spot or spot on spot manner. For the purpose of forming process color images, the transfer is in a spot on spot mariner including the combinations of up to three colors, one selected from each of the print engines 200. On the other hand, for the purpose of creating highlight or logo color images, the transfer may be in either a spot on spot or spot next to spot manner.

Figure 3:
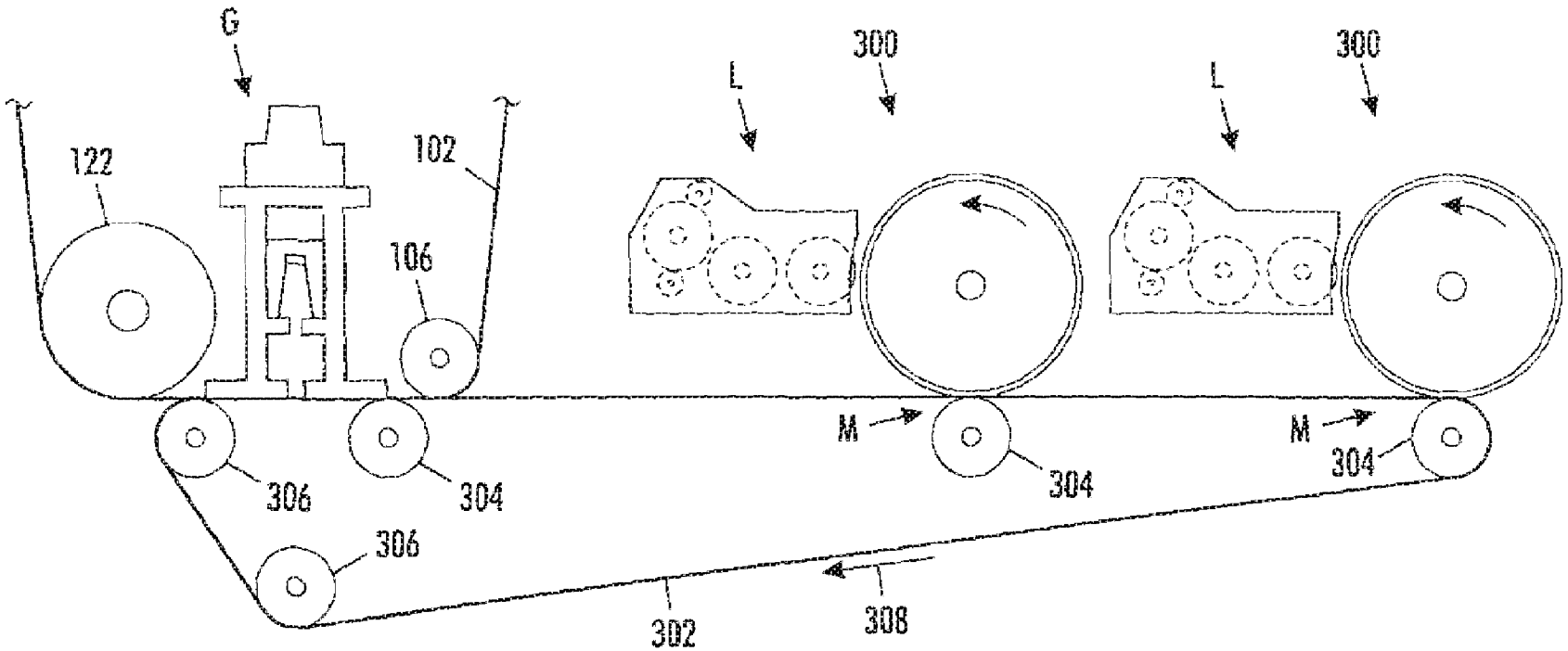
FIG. 3 illustrates a portion of an exemplary embodiment of a printing machine having a hybrid development architecture including two sets of different development housings and a biased transfer belt.

FIG. 3 illustrates a portion of an exemplary embodiment of a printing machine having a hybrid development architecture including two sets of different development housings 300 and a biased transfer belt (BTB) 302. The hybrid architecture may provide improved color gamut and enhanced transfer performance. The hybrid architecture may combine elements of image-on-image (IOI) technology and tandem technology as well as semi-conductive magnetic brush development and emulsion aggregation (SCMB/EA) technology. Other embodiments may employ various other development technologies, such as standard magnetic development.

The additional development housings 300 are arranged in tandem and are in addition to a number (e.g., four, one for each of the CYMK colors) of development housings (not shown) in an image-on-image configuration, which may be oriented as shown in FIG. 1. In this example, four color images developed on the surface of the photoreceptor 102 in the image-on-image configuration may be directly transferred to the substrate or additional toners may be added. The additional development housings 300 may act as an annotator or spot color applicator and/or generally improve color gamut (i.e., extend the color space). For example, two additional colors (e.g., a light magenta and a light cyan) may be developed at transfer stations M by the additional development housings 300. These additional colors may assist in generating better saturation in all the primary colors that may be developed on the photoreceptor 102 and transferred to a substrate passing between the photoreceptor 102 and the biased transfer belt 302 at transfer station G. The additional development housings 300 may provide other functions, such as five or six colors, custom colors, glossing and the like.

The additional development housings 300 and the biased transfer belt 302 may replace an existing pre-fuser transport, taking up substantially the same amount of space. Alternatively, they may replace an existing corona transfer system. Thus, these embodiments may be implemented as an upgrade to existing printing machines.

The biased transfer belt (BTB) 302 is entrained around a number of biased transfer rollers (BTRs) 304 and other rollers 306 and adapted to rotate in a clockwise direction indicated by arrow 308. The biased transfer rollers 304 may be made out of many different materials, such as metal, chloroprene rubber, a polyamid material or a relaxable elastomer, foam rubber, or a semiconductive foam material, depending on the requirements for registration, process speed and the like. The biased transfer rollers provide mechanical pressure as well as an electrostatic field to generate a transfer field at the transfer stations G, M to transfer the toner to the substrate. By using both mechanical and electrostatic pressure, the substrate remains substantially flat to provide tighter control of any air gap.

In one embodiment, the transfer of toner layers at the transfer station G may be further assisted by the application of acoustic energy to the toner particles, which is especially helpful with rough or textured substrates, such as embossed paper for wedding invitations. For such rough substrates, the biased transfer belt 302 may be made of conformable materials and a little thicker than usual in order to ensure a quality image is transferred.

The biased transfer belt 302 enhances transfer performance and provides a transport function for both images and substrates. That is, the biased transfer belt 302 not only transfers toner from the photoreceptor 102 to the substrate but also moves the substrate electrostatically from an input (not shown) through the various transfer stations C, M out to the fuser station (not shown). The biased transfer belt 302 improves image quality (e.g., reducing mottle, image noise, deletions, and lead and trail edge defects) and adds flexibility in field optimization, especially for lightweight substrates, such as those commonly used in textbooks. The biased transfer belt 302 also improves transfer for a broader range of substrates than conventional printing machines.

The biased transfer rollers 304 are preferably located within the transfer stations G, M to minimize pre-nip fields and to maximize stripping post-nip fields. The proper nip pressure is applied to the interface between the biased transfer rollers 304, the biased transfer belt 302, the substrate, and the photoreceptor 102. The proper voltage is applied and controlled, typically by substantially constant current control. The biased transfer roller 304 current is used to maintain the proper transfer field to minimize over-voltage defects or under-voltage transfer efficiency defects. In certain embodiments, the biased transfer belt 302 may be brought into contact with the photoreceptor 102 and the toner image through the use of a camming mechanism (not shown). The speed of the biased transfer belt 302 is regulated in order to maintain the proper relationship between surface speeds of the photoreceptor 102, the substrate and the biased transfer belt 302. The biased transfer belt 302 may have a layer construction and or a back coating to improve the motion quality of the biased transfer rollers 304. The biased transfer rollers 304 are usually not driven, but rather freely roll with the biased transfer belt 302.

It is desirable to minimize any wrinkles or motion quality aberrations that may cause air gaps to form between the image-laden photoreceptor 102 and the biased transfer belt 302/substrate interface. It is also desirable to utilize small diameter rollers on the exit of the belt module in order to facilitate self-stripping of the substrate from the biased transfer belt 302. After the last tandem development station L, the charge on the biased transfer belt 302 may also be neutralized. On the paper inlet side, before transfer station G, the substrate is preferably introduced into the nip formed between the drive roller 122 and the roller 306 such that the substrate achieves a certain degree of flatness to minimize any air gap prior to the introduction of a transfer field. In addition, the biased transfer belt 302 may be tensioned in a way to maintain drive capacity and flatness.

In an exemplary embodiment, the biased transfer belt and tandem development housings can replace a conventional corolla transfer system, adding an improved transfer mechanism and the ability to add fifth or sixth colors for gamut extension, custom color or gloss. For example, four color (CYMK) images may be developed by the four developer housing on the image-on-image photoreceptor and directly transferred to a desired substrate media. This unfused print may then be transported by the biased transfer belt downstream to the second set of developer housings (tandem) for application of a fifth or sixth color from another photoreceptor in tandem. Then, the six colors on the substrate may be sent on the biased transfer belt to a fuser. Thus, the additional developer housings may act as an annotator spot color application or gamut extension to a base image-on-image print engine assembly.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A xerographic printing machine with a hybrid development architecture, comprising:

a photoreceptor;

a plurality of first development housings arranged in an image-on-image configuration in proximity to the photoreceptor;

a biased transfer belt in proximity to the photoreceptor at a transfer station;

at least two second development housings arranged in a tandem configuration in proximity to the biased transfer belt; and a fuser in proximity to the biased transfer belt.

2. The xerographic printing machine of claim 1, wherein the first and second development housings include a plurality of color toners.

3. The xerographic printing machine of claim 1, wherein at least one of the first or second development housings performs semi-conductive magnetic brush development.

4. The xerographic printing machine of claim 1, wherein the first development housings are four development housings, each housing including one of four different color toners.

5. The xerographic printing machine of claim 4, wherein the second development housings include at least two additional color toners.

6. The xerographic printing machine of claim 5, wherein the second development housings provide at least one of gamut extension, custom color, spot color and gloss.

7. The xerographic printing machine of claim 1, further comprising:

a plurality of biased transfer rollers, the biased transfer belt being entrained around the biased transfer rollers and adapted to rotate.

8. The xerographic printing machine of claim 7, wherein at least one of the biased transfer rollers is sized to allow a substrate to self-strip from the surface of the biased transfer belt.

9. The xerographic printing machine of claim 7, wherein the biased transfer belt and the biased transfer rollers provide a mechanical pressure and electrostatic field to provide transfer.

10. The xerographic printing machine of claim 1, wherein the biased transfer belt has a plurality of layers.

11. A xerographic printing machine, comprising:

a photoreceptor;

four first development housings arranged in an image-on-image configuration in proximity to the photoreceptor, each first development housing including a different one of: cyan, yellow, magenta and black development material;

a biased transfer belt in proximity to the photoreceptor at a transfer station, the biased transfer belt being driven to rotate by a plurality of biased transfer rollers;

at least two second development housings arranged in a tandem configuration in proximity to the biased transfer belt, each second development housing including at least one additional color to provide: gamut expansion, spot color, custom color and/or gloss; and a fuser in proximity to the biased transfer belt, wherein the biased transfer belt and the biased transfer rollers provide a mechanical pressure and an electrostatic field to provide transfer of a color image from the photoreceptor onto a substrate and transport of the substrate past the at least two second development housings and to the fuser.

12. The xerographic printing machine of claim 11, wherein the transferred color image is transferred to the substrate and directly output to the fuser without the use of the second development housings.

13. The xerographic printing machine of claim 11, wherein at least one of the first or second development housings performs semi-conductive magnetic brush development.

14. The xerographic printing machine of claim 11, wherein at least one of the biased transfer rollers is sized to allow a substrate to self-strip from a surface of the biased transfer belt.

15. The xerographic printing machine of claim 11, wherein the biased transfer belt has a plurality of layers.

16. A method of using a xerographic printing machine with a hybrid development architecture, comprising:

developing an image onto a photoreceptor using a plurality of first development housings arranged in an image-on-image configuration in proximity to the photoreceptor;

driving a biased transfer belt to rotate in contact with a plurality of biased transfer rollers, the biased transfer belt being in proximity to the photoreceptor at a transfer station to effect transfer of the image from the photoreceptor to a substrate;

developing another image onto the substrate using at least two additional developer materials in at least two second development housings arranged in a tandem configuration in proximity to the biased transfer belt.

17. The method of claim 16, further comprising:

developing four colors using the first development housings, each of the first development housing including developer materials to develop a different one of cyan, yellow, magenta and black.

18. The method of claim 16, further comprising:

developing at least two of, gamut expansion, spot color, custom color and gloss using the at least two second development housings.

19. The method of claim 16, further comprising:

providing a mechanical pressure and an electrostatic field with the biased transfer belt to assist in transferring a color image from the photoreceptor onto a substrate and to transport the substrate past the at least two second development housings and to a fuser in proximity to the biased transfer belt.

20. The method of claim 16, further comprising:

self-stripping the substrate form the biased transfer belt.

* * * * *